US007717103B2

(12) United States Patent
Johnson

(10) Patent No.: US 7,717,103 B2
(45) Date of Patent: May 18, 2010

(54) ARROW REST ASSEMBLY FOR AN ARCHERY BOW

(76) Inventor: Steven C. Johnson, Spot-Hogg Archery Products, 125 Smith St. P.O. Box 226, Harrisburg, OR (US) 97446

( * ) Notice: Subject to any disclaimer, the term of this patent is extended or adjusted under 35 U.S.C. 154(b) by 457 days.

(21) Appl. No.: 11/877,629

(22) Filed: Oct. 23, 2007

(65) Prior Publication Data

US 2009/0101127 A1 Apr. 23, 2009

(51) Int. Cl.
*F41B 5/22* (2006.01)

(52) U.S. Cl. ..... 124/44.5; 74/63; 74/66; 74/68; 124/25.6

(58) Field of Classification Search ..... 74/63, 74/66, 67, 68; 124/25.6, 44.5
See application file for complete search history.

(56) References Cited

U.S. PATENT DOCUMENTS

| | | | | |
|---|---|---|---|---|
| 4,803,971 | A * | 2/1989 | Fletcher | 124/44.5 |
| 5,150,700 | A * | 9/1992 | Troncoso | 124/44.5 |
| 5,490,492 | A * | 2/1996 | Savage | 124/44.5 |
| 6,044,832 | A | 4/2000 | Piersons | |
| 6,814,068 | B1 * | 11/2004 | Troncoso et al. | 124/44.5 |

* cited by examiner

*Primary Examiner*—John Ricci
(74) *Attorney, Agent, or Firm*—David S. Alavi

(57) ABSTRACT

An arrow rest assembly is connected to an archery bow so that an arrow rest is: (i) positioned to support the shaft of an arrow nocked and ready for drawing or drawn and ready for shooting, (ii) positioned to support the shaft of the arrow during an early portion of shooting of the arrow by the bow, and (iii) to allow substantially unimpeded passage of the fletching of the arrow during only the latter portion of shooting of the arrow by the bow. The arrow rest assembly exerts only substantially negligible force on any cable of the bow when the bow is drawn.

24 Claims, 15 Drawing Sheets

ARROW REST ASSEMBLY FOR AN ARCHERY BOW

BACKGROUND

The field of the present invention relates to archery bows. In particular, an arrow rest assembly for an archery bow is disclosed herein.

An arrow rest is a structural member attached to an archery bow, typically on the bow's riser or handle, that is arranged to support the shaft of the arrow when the bow is drawn or shot. Such support of the shaft can typically enable the archer to shoot more accurately.

Early examples of arrow rests typically comprised rigid, fixed structures. However, such structures interfere with the fletching of the arrow as the fletching passes the arrow rest during shooting of the arrow with the bow, reducing arrow velocity and degrading the accuracy of the bow. This interference could be reduced somewhat, but not eliminated, by a variety of adaptations. In one example, the fixed arrow rest is made somewhat resilient to reduce interference with the fletching. A resilient arrow rest can be made by resiliently biasing (e.g., with a spring) a rigid rest into its support position, or by forming the rest using one or more resilient materials. In another example, a rigid arrow rest is arranged to facilitate passage of the fletching, e.g., by having a bifurcated or forked end of the rest that contacts the arrow, leaving a gap for passage of the fletching. The width of such a gap is limited to less than the arrow shaft diameter, and effectiveness of such an arrangement depends on proper alignment of the fletching of the nocked arrow with the gap.

Later arrow rests were developed using a "fall-away" design wherein the arrow rest is spring or resiliently biased downward (i.e., away from the arrow) and pulled upward to the arrow-supporting position by drawing the bow. This movement is typically achieved by connecting (e.g., with a connecting tie or similar structure) the arrow rest to one of the bow's cables, so that movement of that cable during drawing of the bow pulls the arrow rest up into its arrow-supporting position. The arrow rest is therefore in proper position to support the front end of the arrow when the bow is drawn. Upon firing the bow, movement of the bow's cables releases tension on the connecting tie and enables the arrow rest to nearly immediately fall away from the arrow in response to the bias on the rest. Such a fall-away rest moves out of the path of the arrow fletching, but typically only supports the arrow during a relatively small portion of its flight while it is still in contact with the draw cable. While the elimination of interference of the rest with the fletching is desirable, it is achieved at the expense of support of the arrow during only a very limited portion of its flight during firing of the bow.

It is therefore desirable to provide a fall-away arrow rest that substantially reduces or eliminates interference between the arrow fletching and the rest while nevertheless supporting the arrow shaft during a majority of its flight during shooting of the arrow by the bow.

A wide variety of arrow rests or arrow rest assemblies are available. One example is described in U.S. Pat. No. 6,044,832 entitled "Fall-away arrow rest assembly" issued Apr. 4, 2000 to Piersons.

SUMMARY

An arrow rest assembly comprises (i) a support member, (ii) a rotating member, (iii) an arrow rest connected to the rotating member, (iv) a lever comprising first and second lever arms, and (v) a linkage coupling the first lever arm and the rotating member. The rotating member is rotatably mounted on the support member at a first pivot point of the support member, and is biased toward a rest position against a rotation stop. The lever, which comprises first and second lever arms, is rotatably mounted on the support member at a second pivot point of the support member, and is biased toward a cocked position. The linkage couples the first lever arm and the rotating member. The support member, the rotating member, the lever, and the linkage are arranged so that: (i) with only substantially negligible force exerted on the second lever arm, the lever assumes its cocked position in response to its bias; (ii) in response to an external force exerted on the second lever arm to rotate the lever away from its cocked position against its bias, the first lever arm urges the linkage against the rotating member so as to rotate the rotating member away from its resting position against its bias; and (iii) in response to the rotating member being rotated against its bias by the linkage past a release position, the linkage allows the rotating member to rotate to its resting position in response to its bias.

The support member is arranged to be connected to an archery bow so that the arrow rest is positioned (i) to support, with the rotating member in its rest position, the shaft of an arrow nocked and ready for drawing or drawn and ready for shooting, and (ii) to allow, with the rotating member at or past its release position, substantially unimpeded passage of the fletching of the arrow during shooting of the arrow by the bow. The second lever arm is arranged to be connected to a cable of the bow so that (i) the cable exerts only substantially negligible force on the second lever arm with the bow drawn, and (ii) the cable exerts a force on the second lever arm, during only the latter portion of a time interval corresponding to shooting of the arrow by the bow, that urges the linkage against the rotating member so as to rotate the rotating member away from its resting position and past its release position against its bias.

Objects and advantages pertaining to arrow rests may become apparent upon referring to the exemplary embodiments illustrated in the drawings and disclosed in the following written description and/or claims.

Figure 1:
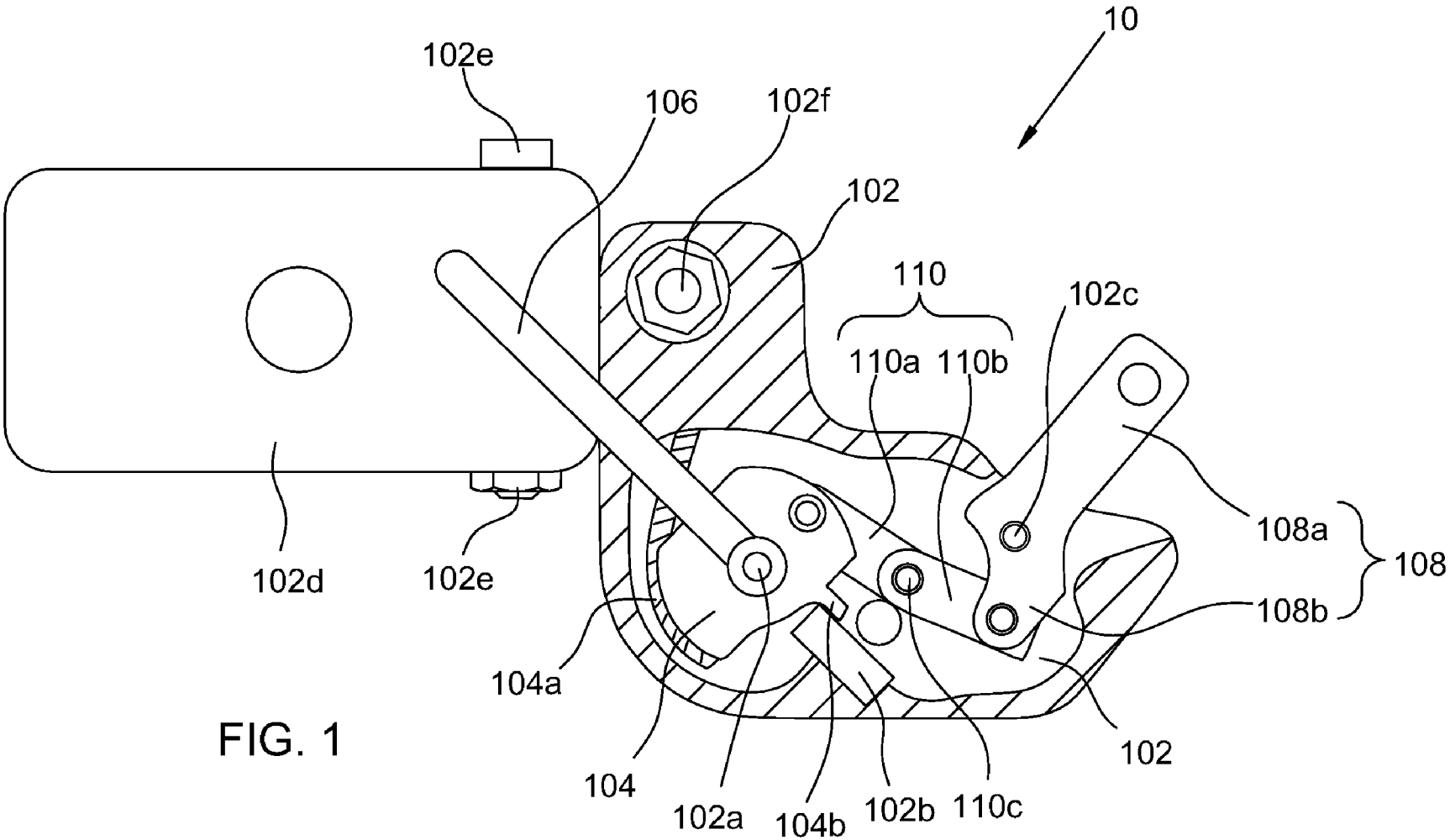
FIGS. 1-4 illustrate schematically the arrangement and operation of an exemplary arrow rest assembly for an archery bow.
Figure 2:
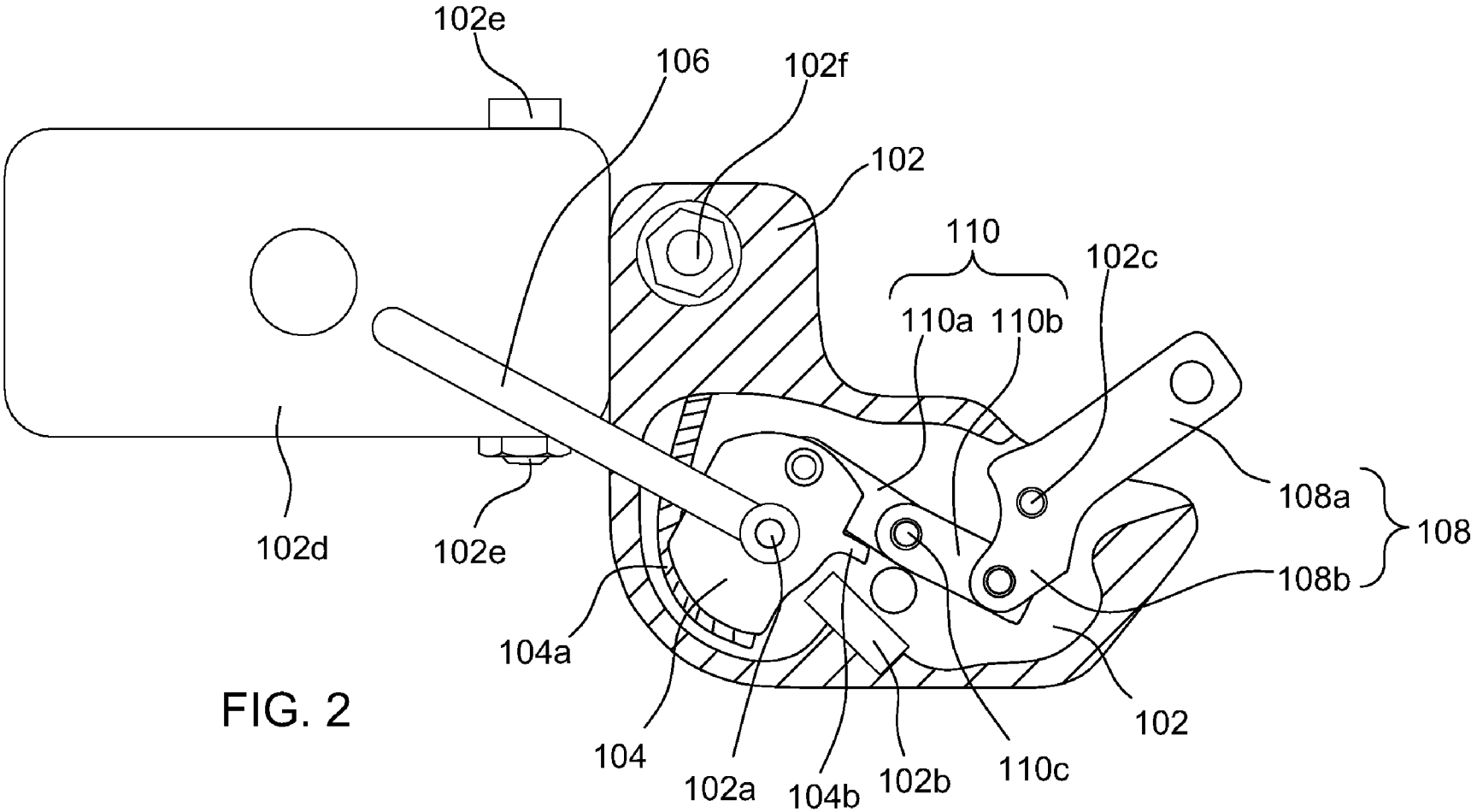
Figure 3:
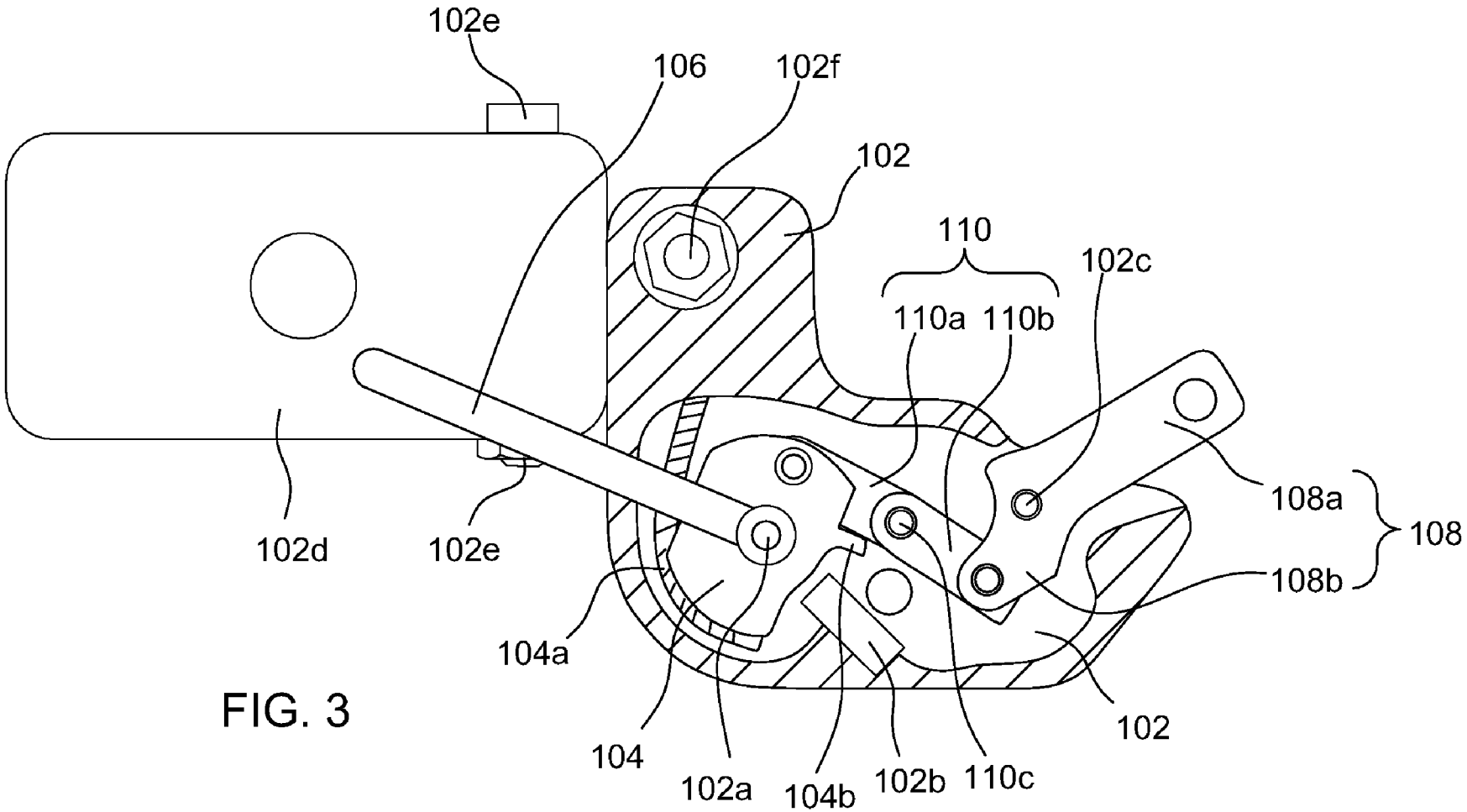
Figure 4:
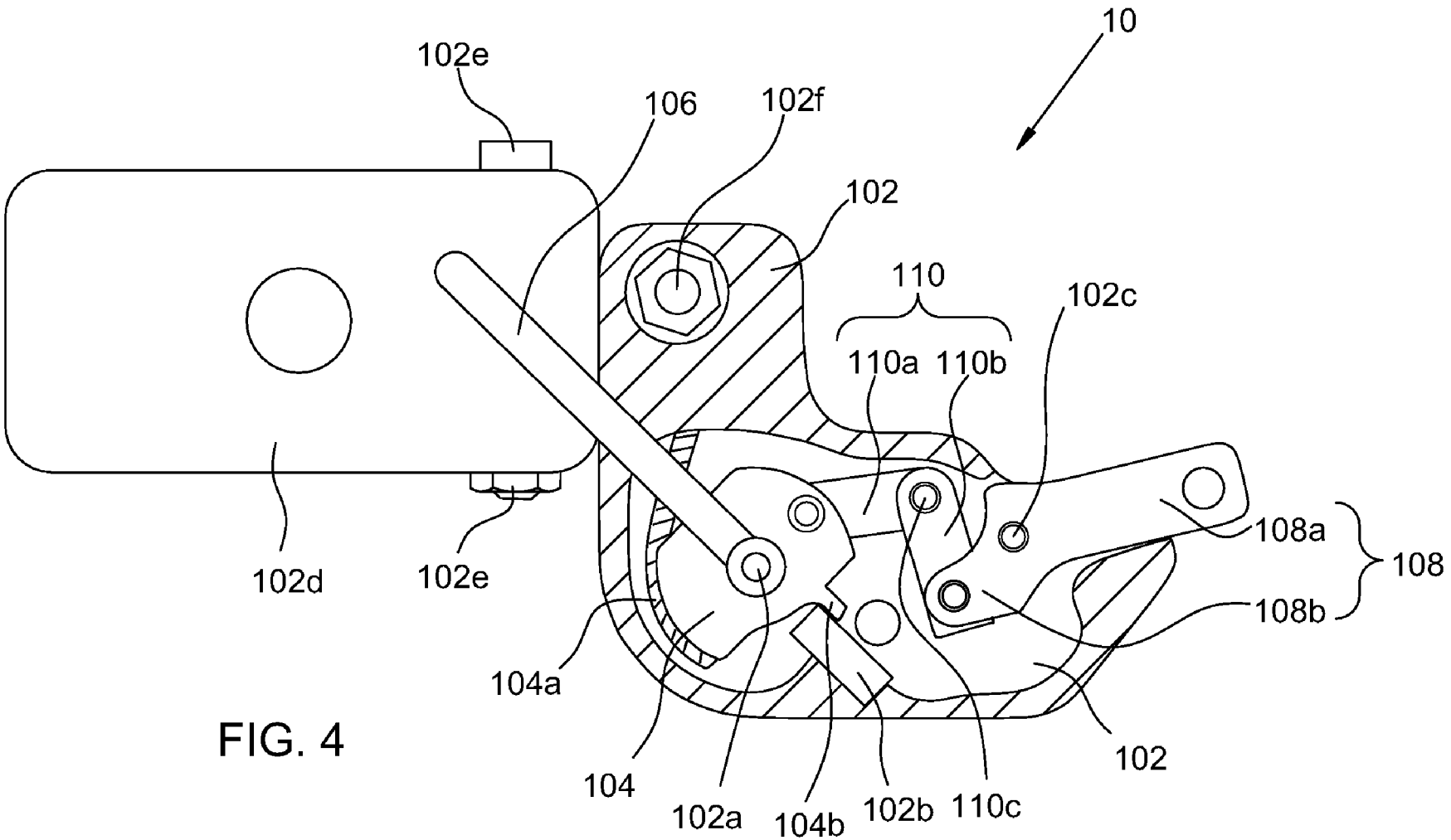
Figure 5:
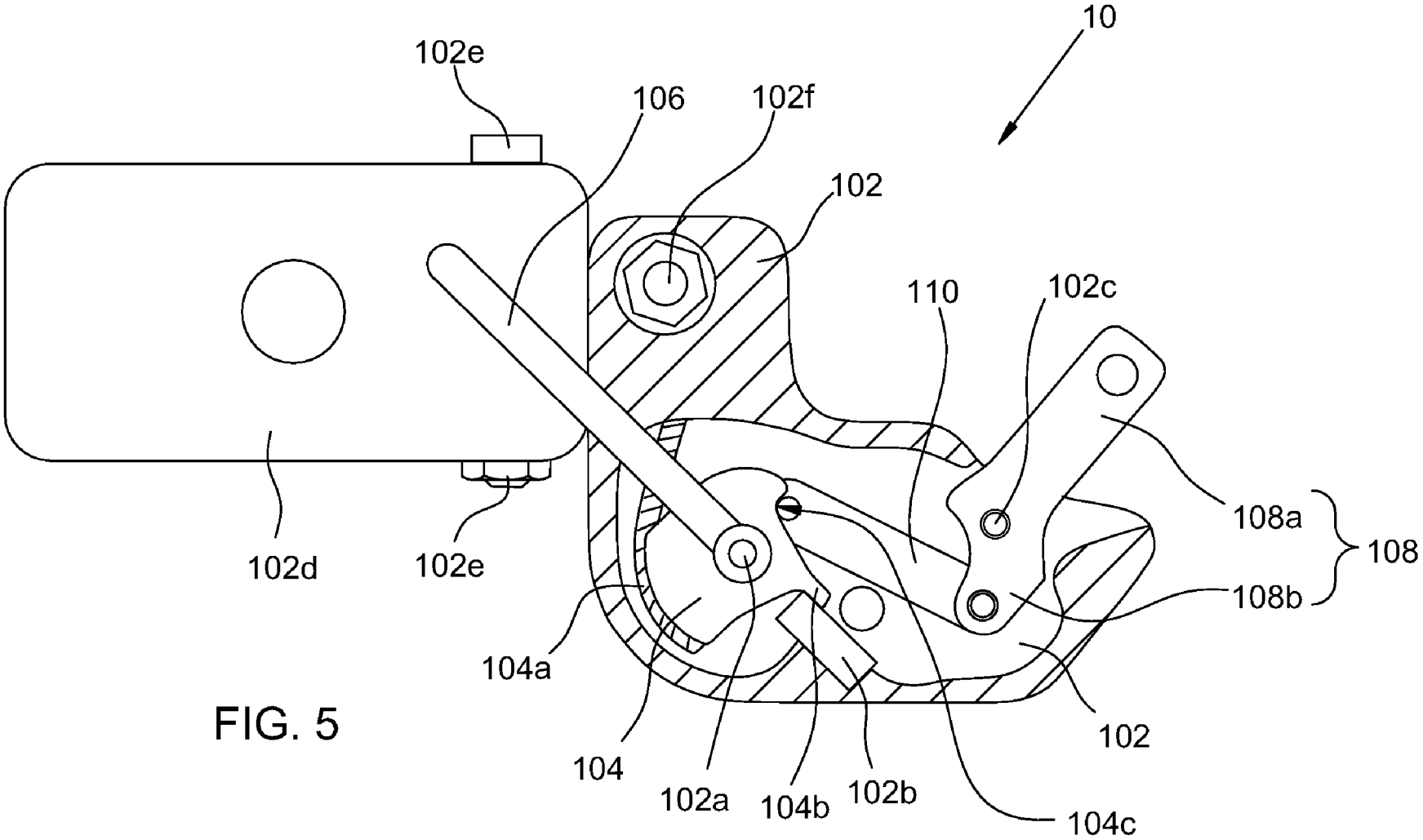
FIGS. 5-8 illustrate schematically the arrangement and operation of another exemplary arrow rest assembly for an archery bow.
Figure 6:
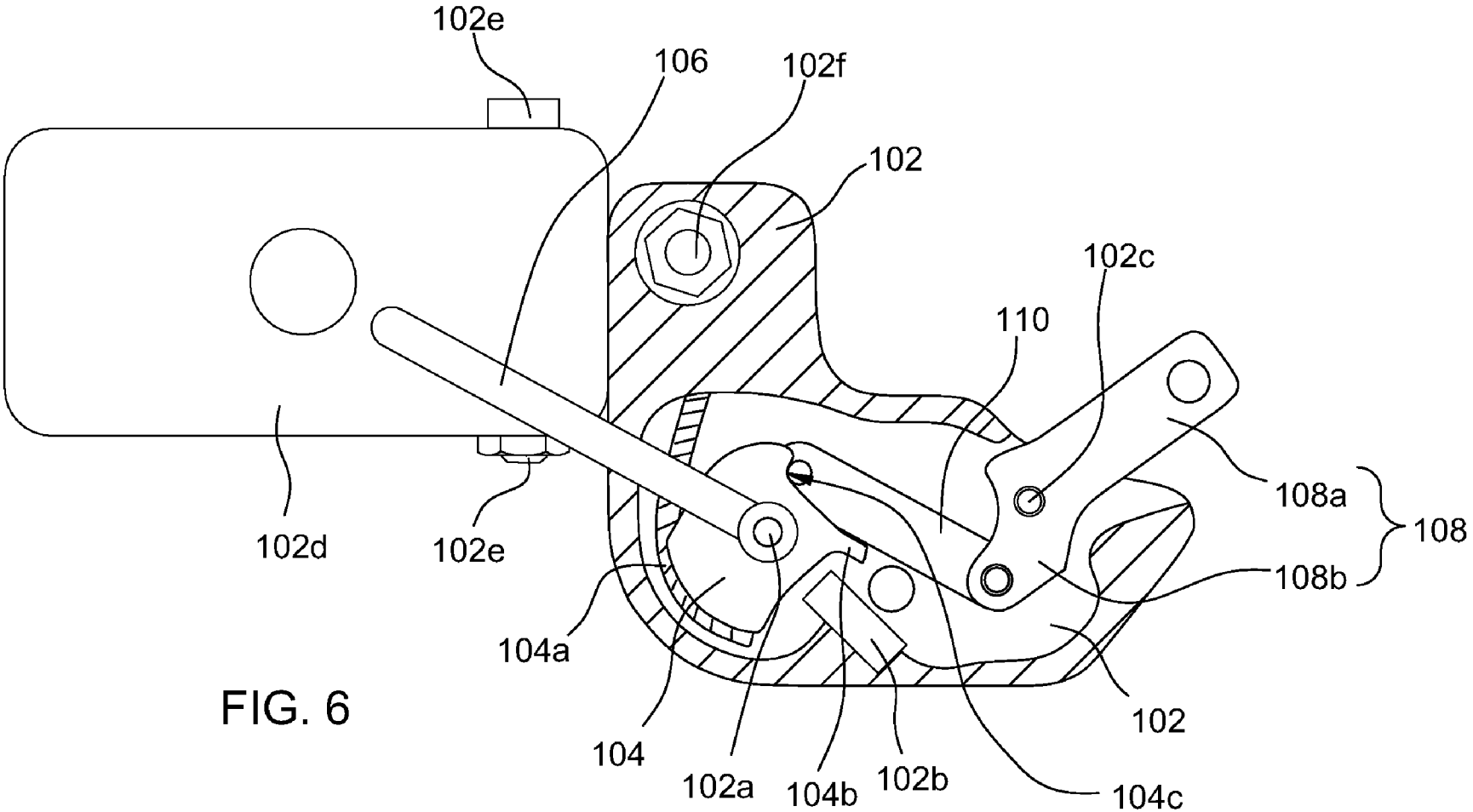
Figure 7:
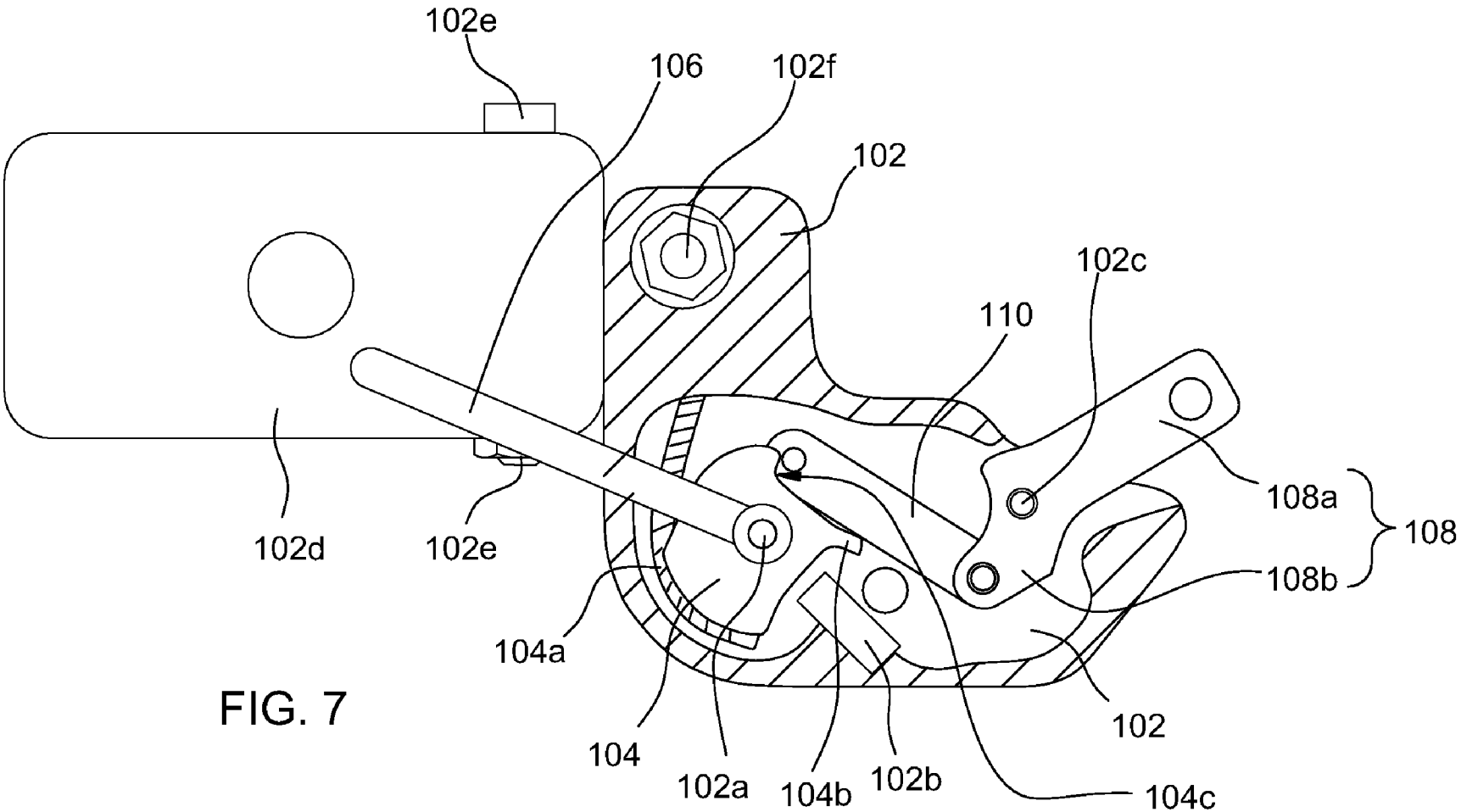
Figure 8:
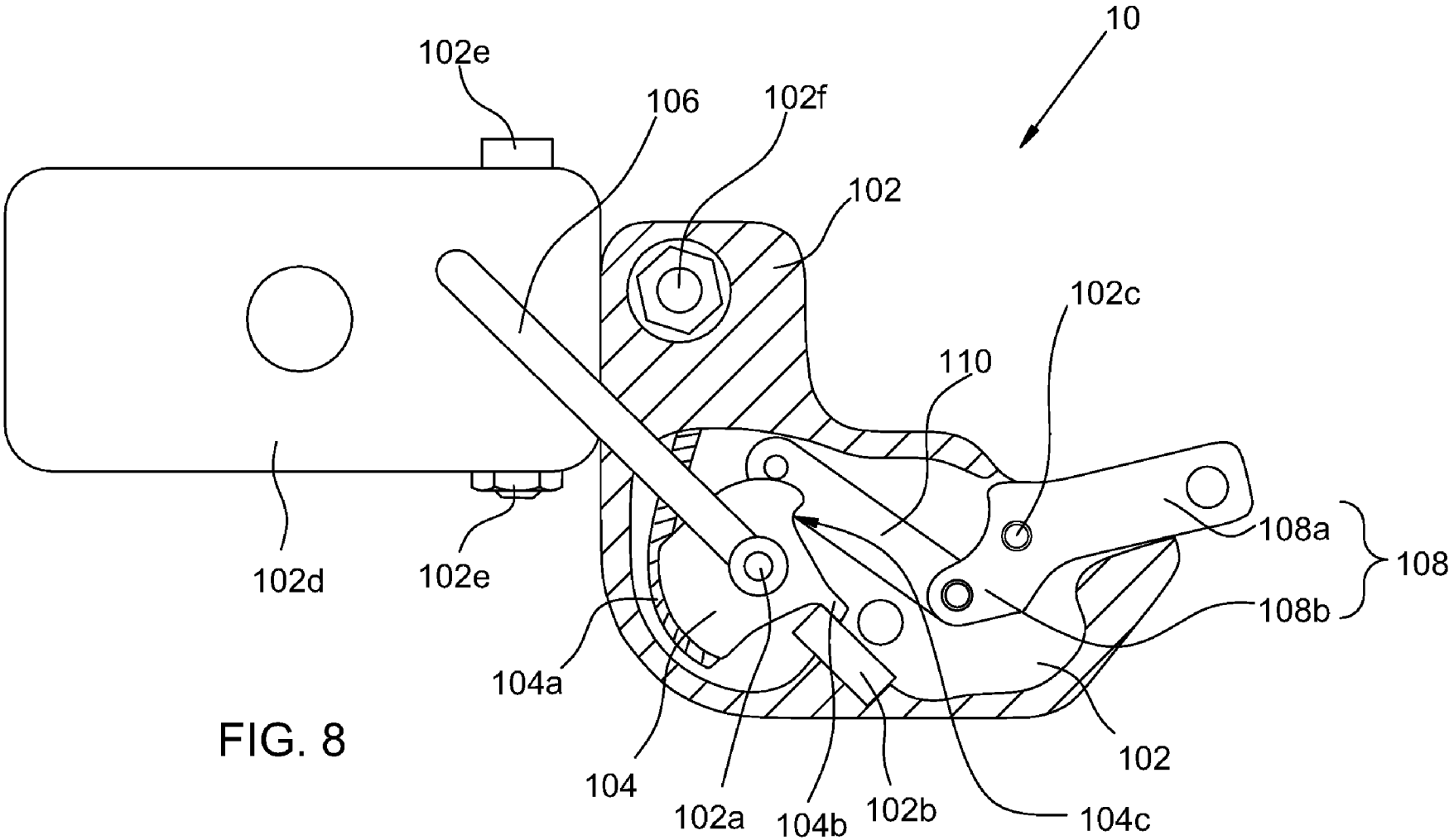

The embodiments shown in the Figures are exemplary, and should not be construed as limiting the scope of the present disclosure and/or appended claims.

DETAILED DESCRIPTION OF EMBODIMENTS

FIGS. 1 through 4 illustrate schematically the arrangement and operation of an exemplary arrow rest assembly 10 that comprises (i) a support member 102, (ii) a rotating member 104, (iii) an arrow rest 106 connected to the rotating member 104, (iv) a lever 108 comprising first and second lever arms 108*a* and 108*b*, respectively, and (v) a linkage 110 coupling the first lever arm 108*a* and the rotating member 104.

The rotating member 104 is rotatably mounted on the support member 102 at a first pivot point 102*a* of the support member 102. The rotating member 104 is biased toward a rest position against a rotation stop 102*b* (as in FIG. 1 or 4) by a spring 104*a*. A linear spring wrapped around a portion of the rotating member 104 is shown in the 11 figures; any other suitable spring, bias mechanism, or biasing arrangement can be employed. The lever 108 is rotatably mounted on the support member 102 at a second pivot point 102*c* of the support member 102, and is biased toward a cocked position (as in FIG. 1; spring or bias mechanism not visible). Any suitable spring (e.g., a torsion spring or linear spring), bias mechanism, or biasing arrangement can be employed to bias lever 108 toward its cocked position.

The support member 102, the rotating member 104, the lever 108, and the linkage 110 are arranged so that: (i) with only substantially negligible force exerted on the second lever arm 108*b*, the lever 108 assumes its cocked position in response to its bias (as in FIG. 1); (ii) in response to an external force exerted on the second lever arm to rotate the lever away from its cocked position against its bias, the first lever arm 108*a* urges the linkage 110 against the rotating member 104 so as to rotate the rotating member 104 away from its resting position against its bias (as in FIG. 2); and (iii) in response to the rotating member 104 being rotated against its bias by the linkage 110 past a release position (as in FIG. 3), the linkage 110 allows the rotating member 104 to rotate to its resting position in response to its bias (as in FIG. 4).

Figure 15:
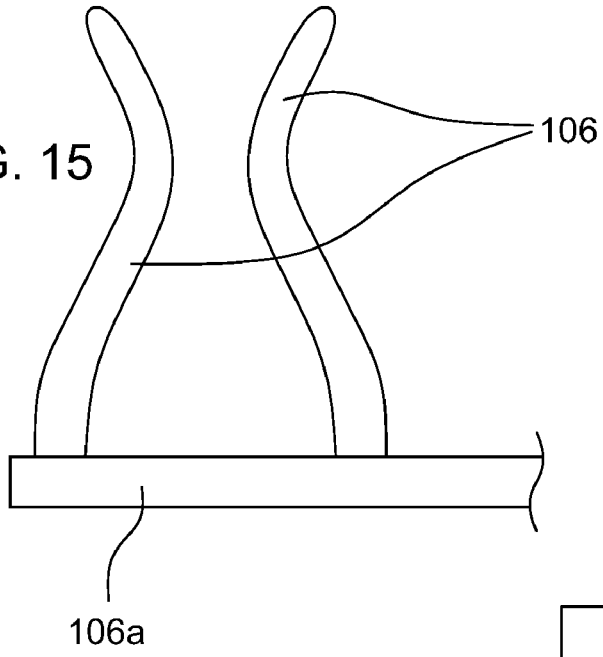
FIGS. 15-17 illustrate schematically several alternative arrow rests.
Figure 16:
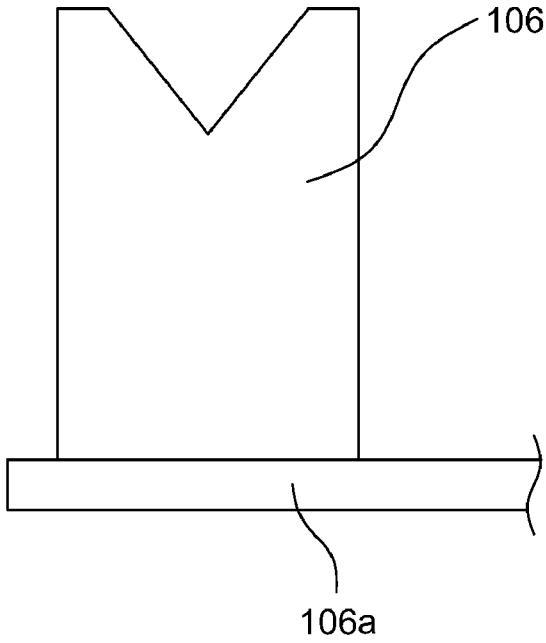
Figure 17:
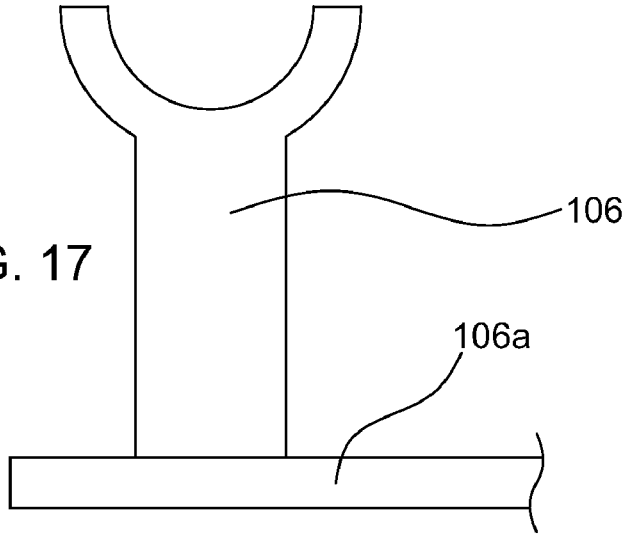

It should be noted that arrow rest 106 and rotating member 104 can comprise a unitary structure (i.e., a single, integrated part), or they can comprise multiple, discrete parts assembled together. Arrow rest 106 can include a two-pronged structure resembling an "hourglass" or a split "Y" shape (FIG. 15), a flattened structure with a "V"- or "U"-shaped notch (FIGS. 16 and 17, respectively), or any other shape or configuration suitable for supporting a shaft of an arrow and at least partly restricting lateral movement of the supported arrow while also enabling longitudinal movement of the arrow when it is shot. A shaft 106*a* is shown in FIGS. 15-17 that connects the arrow rest 106 to the rotating member 104. Any other arrangement for connecting the arrow rest 106 and the rotating member 104 can be employed.

The phrase "time interval corresponding to shooting of the arrow by the bow" refers to the time interval beginning with release of the drawn bowstring (i.e., draw cable) by an archer and ending with the arrow leaving the bowstring and with the bow, bowstring, and cables returning to their rest positions "at brace" (neglecting any subsequent rebound, recoil, oscillations, or vibrations).

The support member 102 is arranged to be connected to an archery bow 20 so that the arrow rest 106 is positioned (i) to support, with the rotating member 104 in its rest position (as in FIG. 1 or 4), the shaft of an arrow nocked and ready for drawing or drawn and ready for shooting, and (ii) to allow, with the rotating member 104 at or past its release position (as in FIG. 3), substantially unimpeded passage of the fletching of the arrow during shooting of the arrow by the bow. The second lever arm 108*b* is arranged to be connected to a cable of the bow so that (i) the cable exerts only substantially negligible force on the second lever arm 108*b* with the bow drawn (as in FIG. 1), and (ii) the cable exerts a force on the second lever arm 108*b*, during only the latter portion of a time interval corresponding to shooting of the arrow by the bow, that urges the linkage 110 against the rotating member 104 so as to rotate the rotating member away from its resting position (as in FIG. 2) and past its release position (as in FIG. 3) against its bias.

In the exemplary arrow rest assembly 10 of FIGS. 1-4, the linkage 110 comprises an over-center linkage having a first linking member 110*a* connected to the first lever arm 108*a* and a second linking member 110*b* connected to the rotating member 104. The first and second linking members 110*a* and 110*b* are connected together at a linkage pivot point 110*c*. The first and second linking members 110*a* and 110*b* are arranged to (i) assume an over-center arrangement with the lever 108 in its cocked position (as in FIG. 1), (ii) remain in the over-center arrangement as the linkage 110 is urged against the rotating member 104 (as in FIG. 2), and (iii) pivot about the linkage pivot point 110*c* out of the over-center arrangement as a result of rotation of the rotating member 104 against its bias past its release position (as in FIG. 3 or 4), thereby enabling the rotating member 104 to rotate to its resting position (as in FIG. 4) in response to its bias. In this exemplary embodiment, the rotating member 104 is arranged (by virtue of a protruding portion 104*b*) to urge the linkage pivot point 110*c* out of the over-center arrangement as the rotating member 104 rotates past its release position against its bias (as in FIG. 3). The protruding portion 104*b* also engages the rotation stop 102*b* in the exemplary embodiment (as in FIG. 1 or 4). Any other suitable arrangement of the linkage 110 can be employed that forces the linkage pivot point 110*c* out of the over-center arrangement as the rotating member 104 rotates past its release point. For example, a portion of the support member 102 can be arranged to engage a suitably arranged portion of linkage 110 to force the linkage pivot point 110*c* out of the over-center arrangement as rotating member 104 rotates past its release point. Similarly, any suitable arrangement of the rotating member 104 and rotation stop 102*b* can be employed for holding the rotating member 104 at its resting position against its bias.

Figure 9:
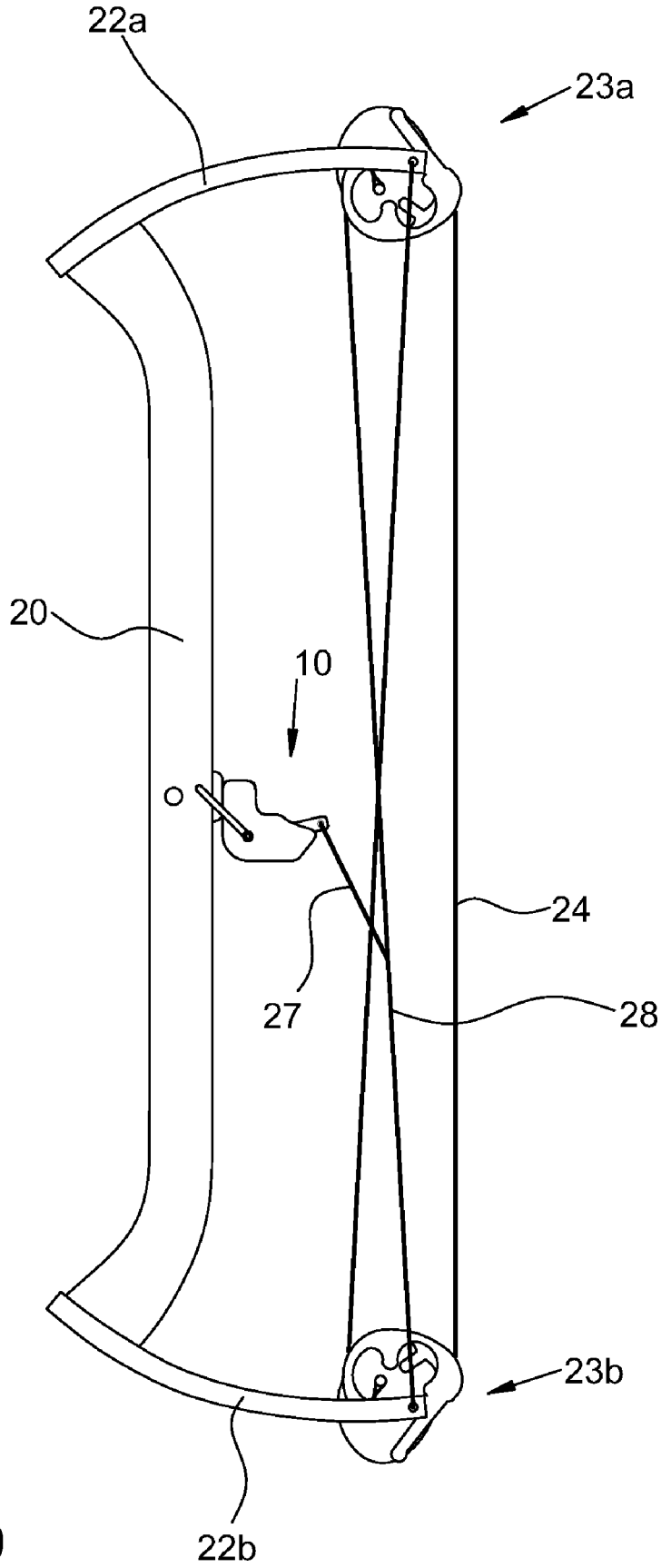
FIGS. 9 and 10 illustrate schematically exemplary archery bows incorporating an arrow rest assembly.
Figure 10:
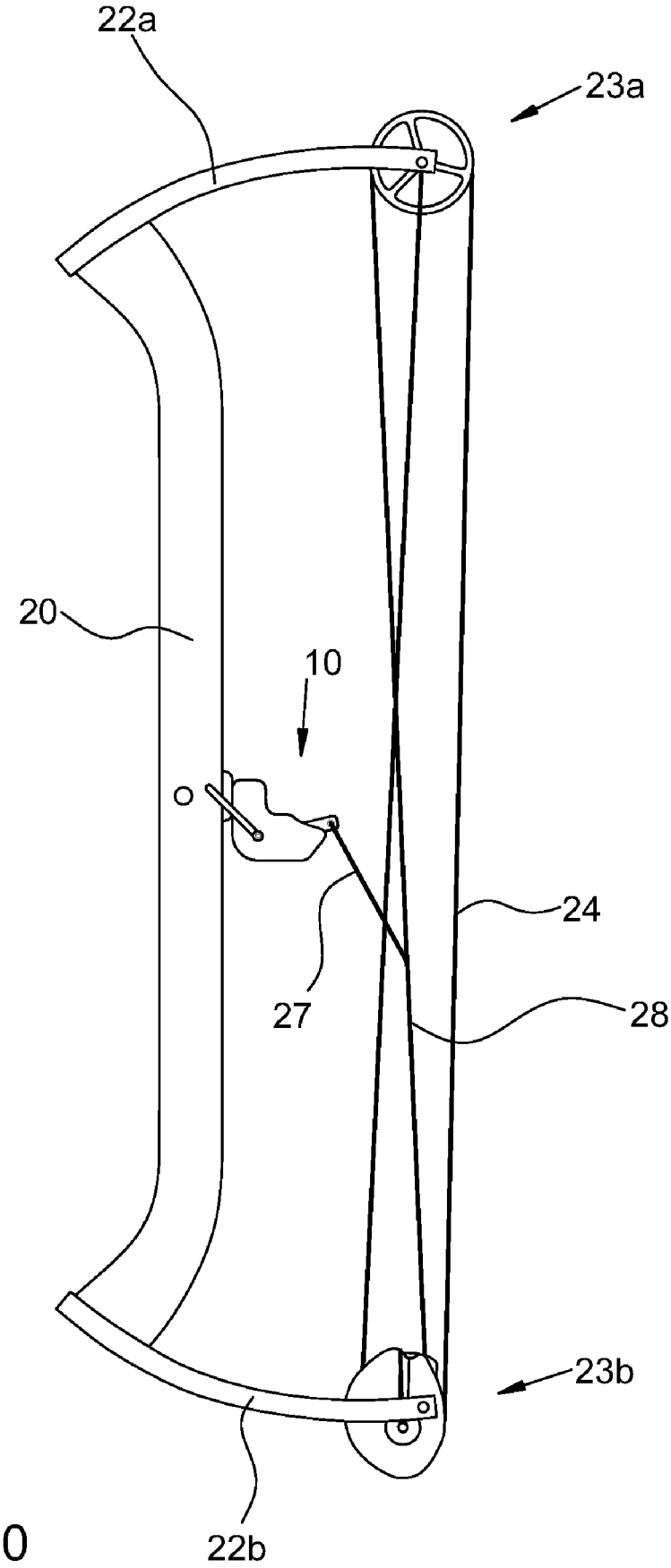
Figure 11:
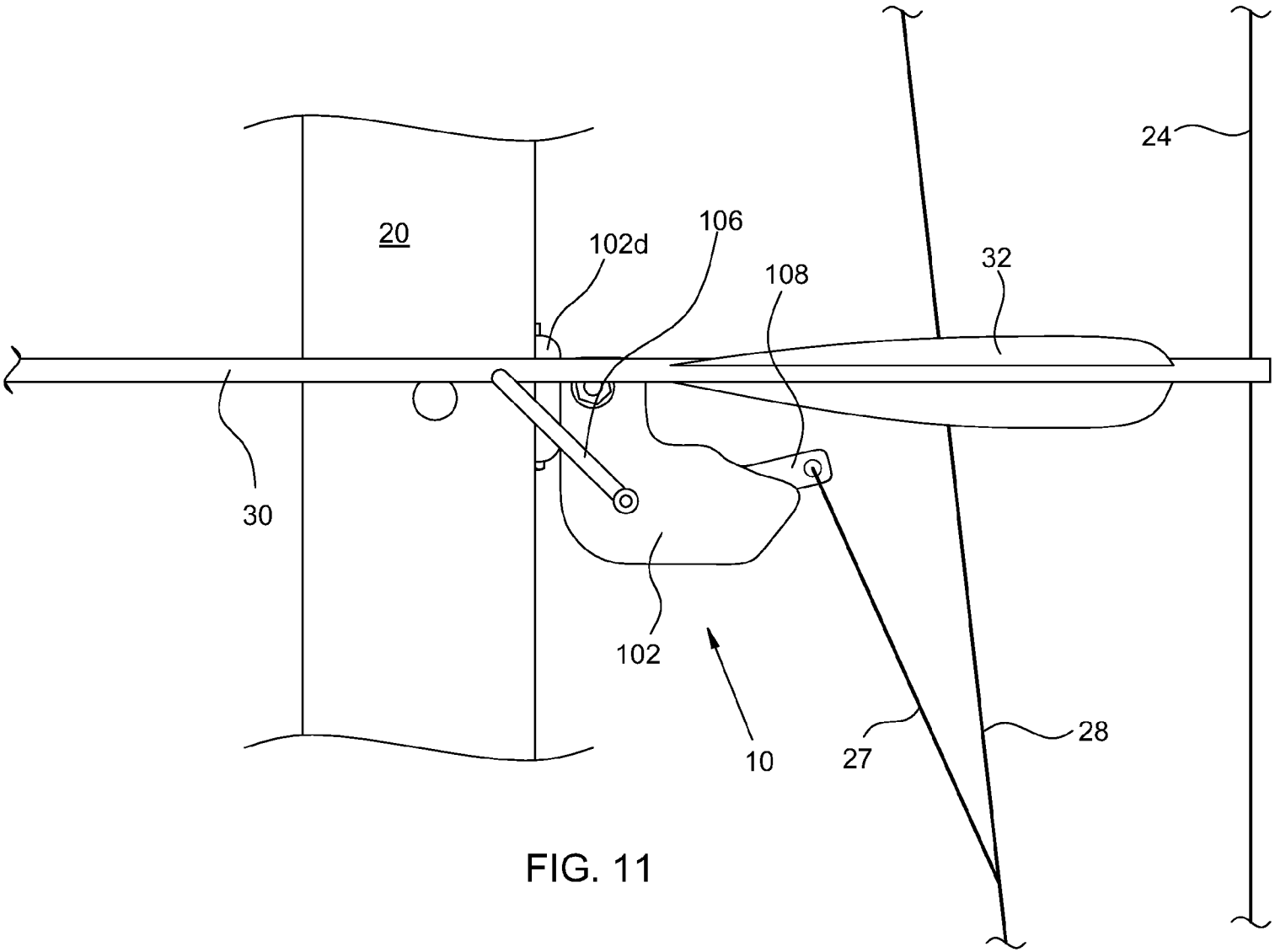
FIGS. 11-14 illustrate schematically operation of an archery bow incorporating an arrow rest assembly.
Figure 12:
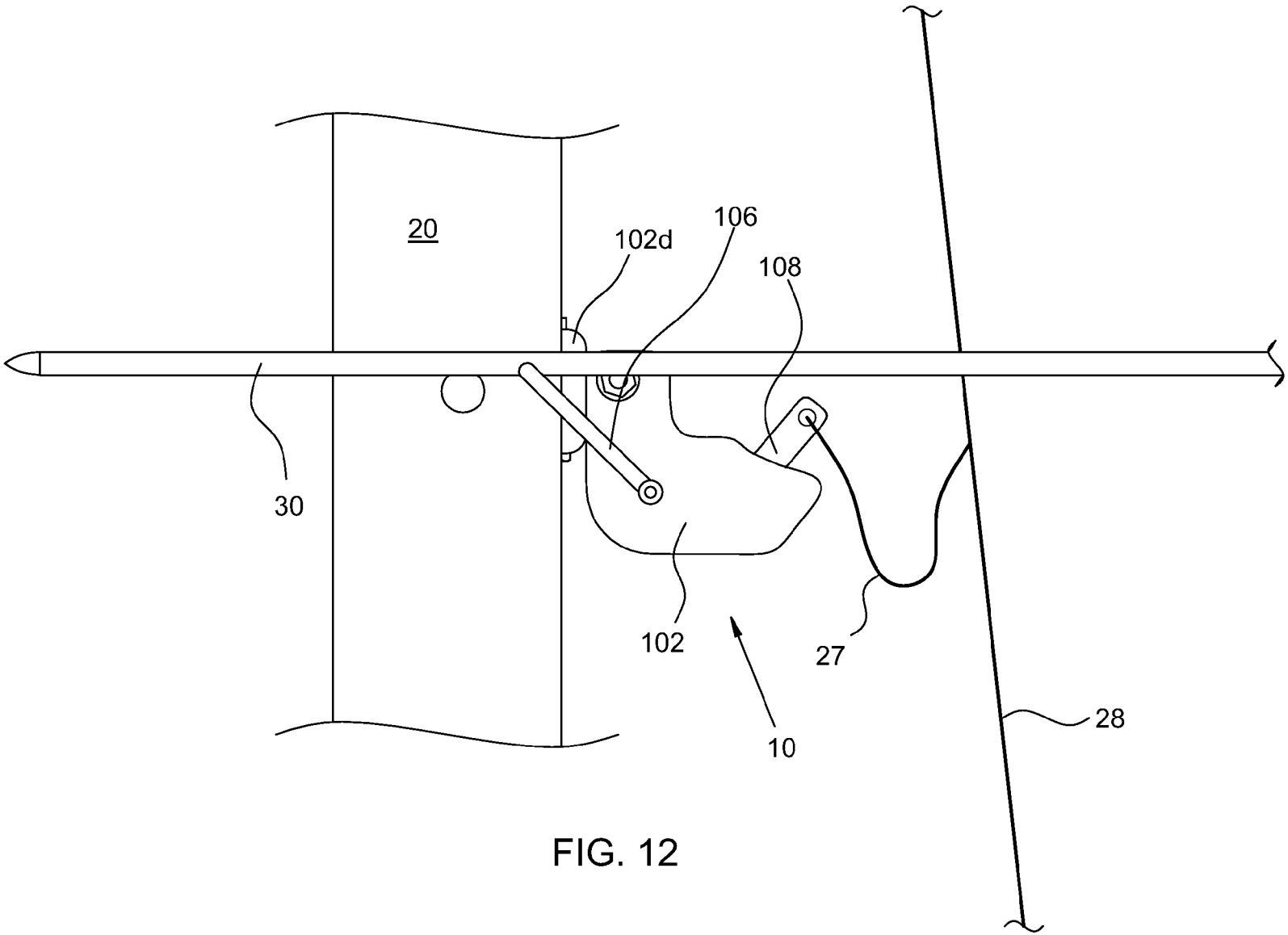
Figure 13:
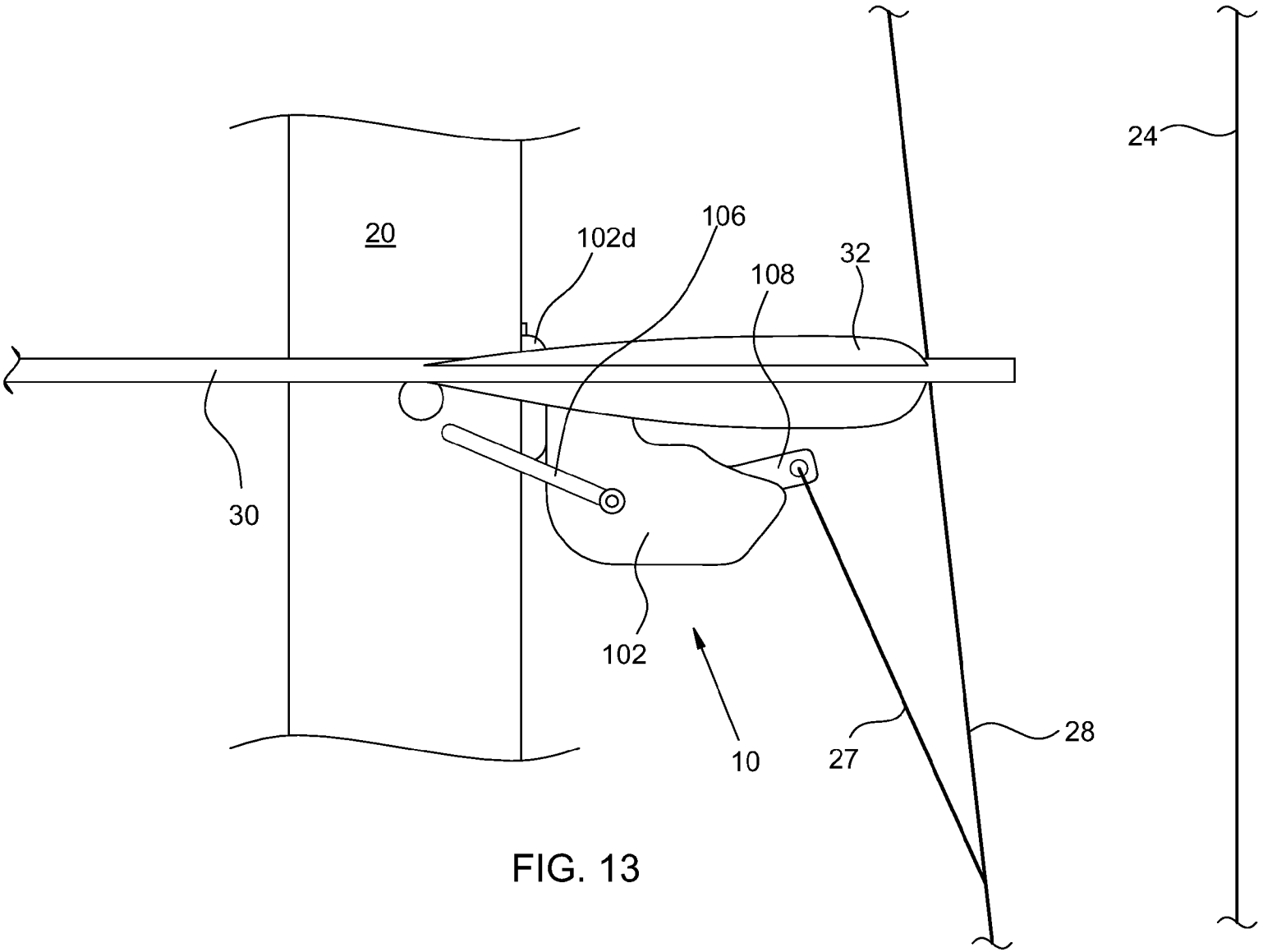
Figure 14:
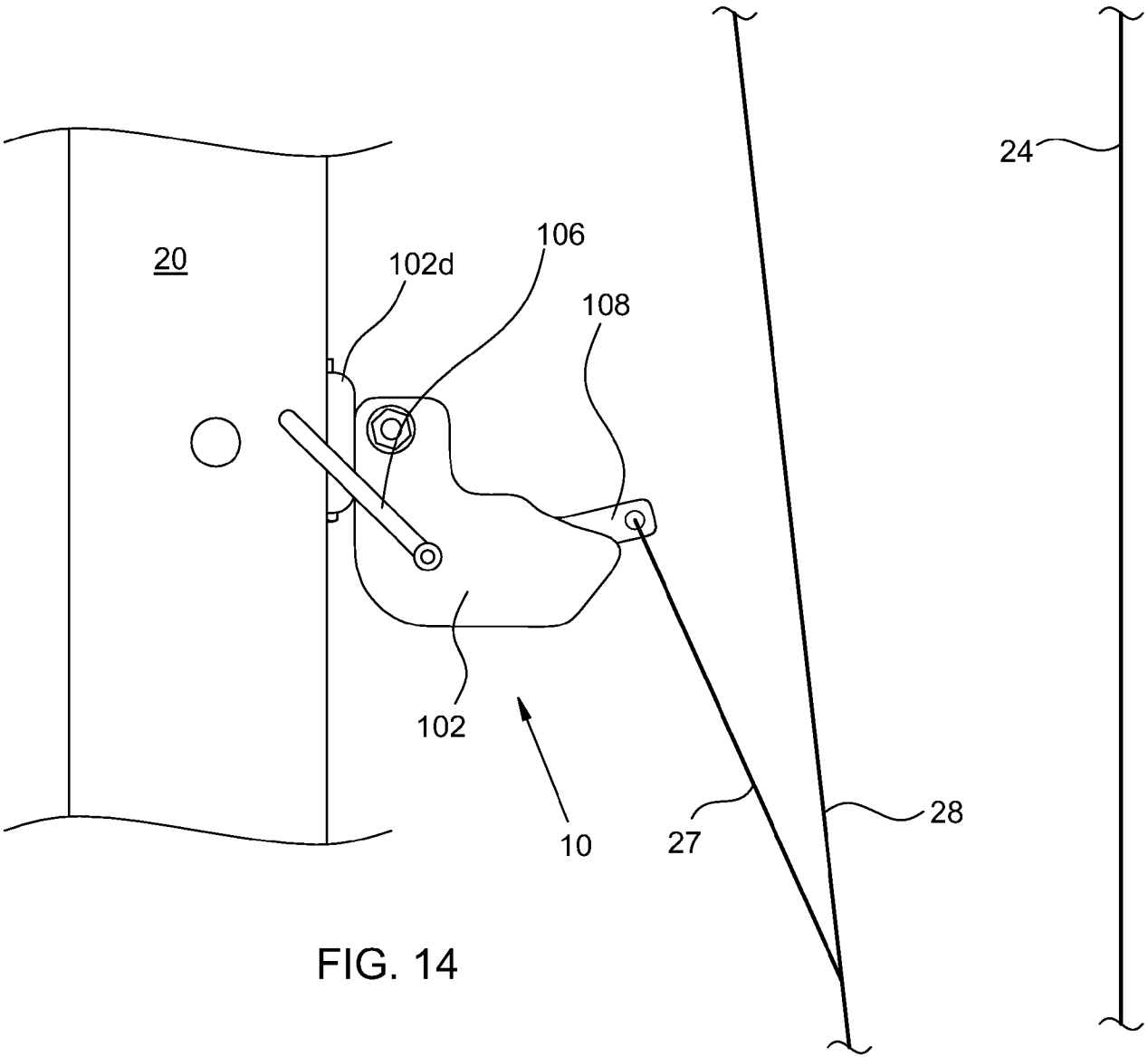

Two different examples of an archery bow 20 are illustrated schematically in FIGS. 9 and 10; FIG. 9 depicts a dual-cam compound bow and FIG. 10 depicts a single- or solo-cam compound bow. The archery bow 20 comprises (i) oppositely projecting first and second bow limbs 22*a* and 22*b*, (ii) a first pulley member 23*a* pivotably connected to the first bow limb 22*a*, (iii) a second pulley member 23*b* pivotably connected to the second bow limb 22*b*, (iv) a draw cable 24 engaged with the first and second pulley members 23*a* and 23*b*, (v) at least one additional cable 28 engaged with the first or second pulley member 23*a* or 23*b*, and (vi) an arrow rest assembly 10 as described above. The support member 102 of the arrow rest assembly 10 is connected to the bow 20 so that the arrow rest 106 is positioned (i) to support, with the rotating member 104 in its rest position, the shaft of an arrow 30 nocked and ready for drawing (as in FIG. 11) or drawn and ready for shooting (as in FIG. 12), and (ii) to allow, with the rotating member 104 at or past its release position (as in FIG. 13), substantially unimpeded passage of the fletching 32 of the arrow 30 during shooting of the arrow 30 by the bow 20. The second lever arm 108*b* is arranged to be connected to the additional cable 28 of the bow 20 so that (i) the additional cable 28 exerts only substantially negligible force on the second lever 108*b* arm with the bow drawn (as in FIG. 12), and (ii) the additional cable 28 exerts a force on the second lever arm 108*b*, during only the latter portion of a time interval corresponding to shooting of the arrow 30 by the bow 20, that urges the linkage 110 against the rotating member 104 so as to rotate the rotating member 104 away from its resting position and past its release position against its bias (as in FIG. 13). Upon passing its release position, the rotating member 104 returns to its rest position in response to its bias (as in FIG. 14).

The arrow rest assembly 10 can be used with any suitable archery bow, including but not limited to single- or solo-cam, dual-cam, binary cam, hybrid cam, or cam-and-a-half compound bows. The pulley members 23*a* and 23*b* (which can be identical, or mirror images, or different from one another) can comprise one or more cams, pulleys, idler wheels, posts, or other members for providing the desired performance of the bow 20.

In the exemplary embodiments shown in the figures, a flexible tether or cord 27 is connected to the second lever arm 108*b* and arranged to connect the second lever arm 108*b* to the additional cable 28 of the bow 20. Any other suitable connector or connection arrangement can be employed to connect the lever arm 108*b* and the additional cable 28.

In the exemplary embodiment, the second lever arm 108*b* is connected (by the tether 27 in the exemplary embodiment) to a cable 28 that travels upward as the bow 20 is drawn. The upward movement of the cable 28 relieves any force between the cable 28 and the lever 108 (by releasing tension on the tether 27 in the exemplary embodiment) and allows the lever 108 to move to its cocked position in response to its bias. When the draw cable 24 is released to fire the bow 20, the cable 28 travels downward. During only the latter portion of the time interval corresponding to firing of the bow 20, the force between cable 28 and lever arm 108*b* is reestablished by downward movement of the cable 28. The resulting movement of the lever 108 and the linkage 110 causes rotation of the rotating member 104 toward its release point against its bias, in turn moving arrow rest 106 to a position where it allows substantially unimpeded passage of the fletching 32 of the arrow 30. Further movement of the rotating member 104 past its release point results in the linkage 110 allowing the rotating member 104 to return to its resting position in response to its bias, and movement of arrow rest 106 to its position for supporting another arrow. While the lever 108 is connected to a upward-traveling (during draw) cable 28, any other arrangement or orientation for the lever 108 can be employed, with lever arm 108*b* being connected to a cable traveling either upward or downward (during draw) as appropriate for allowing the lever to move to its cocked position during draw and for pulling the lever away from its cocked position during shooting of the arrow.

The relief of force between cable 28 and lever 108 upon drawing the bow 20 ensures that the arrow rest assembly 10 only substantially negligibly affects operating characteristics of the bow 20, e.g., cam timing or holding weight.

The connection between lever arm 108*b* and the cable 28 can be made adjustable, e.g., by adjustment of the length or tension of tether 27, or by any other suitable means, thereby enabling adjustment of the magnitude or timing of the force exerted by the cable 28 on the second lever arm 108*b* during the latter portion of shooting the arrow 30 by the bow 20.

The support member 102 as shown in the exemplary embodiment of FIGS. 1-4 comprises a housing for containing the rotating member 104, the lever 108, and the linkage 110. The housing is shown partly cut away in FIGS. 1-4 but is present and hides rotating member 104 and linkage 110 in FIGS. 11-14. The support member 102 can include a mounting plate 102*d* arranged for enabling mounting of the arrow rest assembly 10 on the handle or riser of a bow. The support member 102 can include adjustment screws 102*e*/102*f* arranged to enable adjustable positioning of the arrow rest assembly on the archery bow. In the exemplary embodiment shown in the figures, two screws are provided for providing adjustment of vertical (102*e*) and horizontal (102*f*) positioning of the arrow rest assembly 10.

The support member 102, the rotating member 104, the lever 108, the linkage 110, and the arrow rest 106 (i.e., the arrow rest assembly 10) can be arranged (by altering shapes or dimensions) to achieve a desired duration of the latter portion of the time interval during shooting of the bow, during which latter portion the arrow rest 106 moves away (as a result of rotation of the rotating member 104 away from its rest position) from the arrow 30 as it is shot from the bow 20. It may be desirable to make the latter portion of the time interval as small as practicable. The arrow rest assembly 10 can be arranged so that said latter portion is less than about 50%, less than about 40%, less than about 30%, less than about 25%, less than about 20%, less than about 15%, or less than about 10% of said time interval. Any of these percentages, or any other suitable or desired percentage, can be employed, with larger percentages reducing potential contact between the arrow rest 106 and the fletching of the arrow, and with smaller percentages increasing the duration of contact between the arrow rest 106 and the arrow 30 as it is shot from the bow 20. Some adjustment of the timing of the arrow rest assembly can be achieved by altering the tension on the connection between lever arm 108*b* and cable 28 (which can include tether 27).

Another exemplary embodiment of an arrow rest assembly 10 is illustrated schematically in FIGS. 5-8. In this embodiment, the linkage 110 comprises a single linking member connected to the first lever arm 108*a*. The rotating member 104 has a notch 104*c* for receiving the linkage 110. The linkage 110 and the rotating member 104 are arranged so that (i) the linkage 110 engages the notch 104*c* with the lever 108 in its cocked position and the rotating member 104 in its resting position (as in FIG. 1), (ii) the linkage 110 remains engaged with the notch 104*c* as the linkage 110 is urged against the rotating member 104 (as in FIG. 6), and (iii) the linkage 110 disengages from the notch 104*c* as a result of rotation of the rotating member 104 past its release position against its bias (as in FIG. 7), thereby enabling the rotating member 104 to rotate to its resting position in response to its bias (as in FIG. 8).

Although several exemplary embodiments have been shown and described herein, many alternative mechanical arrangements can be employed that provide substantially equivalent functionality. Such functionally equivalent alternative arrangements shall fall within the scope of the present disclosure or appended claims.

An arrow rest assembly 10 (arranged according to one of the exemplary embodiments or arranged in any other functionally equivalent manner) can be made by (a) rotatably mounting the rotating member 104 on the support member 102 at the first pivot point 102*a* of the support member 102, and biasing the rotating member 104 toward the rest position against the rotation stop 102*b*; (b) rotatably mounting the lever 108 on the support member at the second pivot point 102*c* of the support member 102, and biasing the lever 108 toward the cocked position; (c) coupling the first lever arm 108*a* and the rotating member 104 with the linkage 110; and (d) arranging the support member, the rotating member, the lever, and the linkage so that (i) with only substantially negligible force exerted on the second lever arm 108*b*, the lever 108 assumes its cocked position in response to its bias, (ii) in response to an external force exerted on the second lever arm 108*b* to rotate the lever 108 away from its cocked position against its bias, the first lever arm 108*a* urges the linkage 110 against the rotating member 104 so as to rotate the rotating member 104 away from its resting position against its bias, and (iii) in response to the rotating member 104 being rotated against its bias by the linkage past a release position, the linkage 110 allows the rotating member 104 to rotate to its resting position in response to its bias.

A method for making the arrow rest assembly 10 can further include: (e) connecting the arrow rest 106 to the rotating member 104; (f) arranging the support member 102 to be connected to the archery bow 20 so that the arrow rest 106 is positioned (i) to support, with the rotating member 104 in its rest position, the shaft of an arrow 30 nocked and ready for drawing or drawn and ready for shooting, and (ii) to allow, with the rotating member 104 at or past its release position, substantially unimpeded passage of the fletching of the arrow 30 during shooting of the arrow by the bow; and (g) arranging the second lever arm 108*b* to be connected to the cable 28 of the bow 20 so that (i) the cable 28 exerts only substantially negligible force on the second lever arm 108*b* with the bow drawn, and (ii) the cable 28 exerts a force on the second lever arm 108*b*, during only the latter portion of a time interval corresponding to shooting of the arrow 30 by the bow 20, that urges the linkage 110 against the rotating member 104 so as to rotate the rotating member 104 away from its resting position and past its release position against its bias.

A method for making an archery bow incorporating the arrow rest assembly 106 can further comprise: (h) pivotably connecting a first pulley member 23*a* to a first bow limb 22*a* of the bow 20; (i) pivotably connecting a second pulley member 23*b* to a second bow limb 22*b* of the bow 20; (j) engaging a draw cable 25 with the first and second pulley members 22*a* and 22*b*; (k) engaging the additional cable 28 with the first or second pulley member 22*a* or 22*b*; (l) connecting the arrow rest assembly 10 to the bow 20; and (m) connecting the second lever arm 108*b* to the cable 28.

It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

What is claimed is:

1. An apparatus comprising:

a support member;

a rotating member rotatably mounted on the support member at a first pivot point of the support member, the rotating member being biased toward a rest position against a rotation stop;

a lever rotatably mounted on the support member at a second pivot point of the support member, the lever comprising first and second lever arms and being biased toward a cocked position; and a linkage coupling the first lever arm and the rotating member, wherein the support member, the rotating member, the lever, and the linkage are arranged so that:

with only substantially negligible force exerted on the second lever arm, the lever assumes its cocked position in response to its bias;

in response to an external force exerted on the second lever arm to rotate the lever away from its cocked position against its bias, the first lever arm urges the linkage against the rotating member so as to rotate the rotating member away from its resting position against its bias; and in response to the rotating member being rotated against its bias by the linkage past a release position, the linkage allows the rotating member to rotate to its resting position in response to its bias.

2. The apparatus of claim 1 further comprising an arrow rest connected to the rotating member, wherein:

the support member is arranged to be connected to an archery bow so that the arrow rest is positioned (i) to support, with the rotating member in its rest position, the shaft of an arrow nocked and ready for drawing or drawn and ready for shooting, and (ii) to allow, with the rotating member at or past its release position, substantially unimpeded passage of the fletching of the arrow during shooting of the arrow by the bow; and the second lever arm is arranged to be connected to a cable of the bow so that (i) the cable exerts only substantially negligible force on the second lever arm with the bow drawn, and (ii) the cable exerts a force on the second lever arm, during only the latter portion of a time interval corresponding to shooting of the arrow by the bow, that urges the linkage against the rotating member so as to rotate the rotating member away from its resting position and past its release position against its bias.

3. The apparatus of claim 2 wherein the support member includes adjustment screws arranged to enable adjustable positioning of the support member on the archery bow.

4. The apparatus of claim 2 further comprising a flexible tether connected to the second lever arm and arranged to connect the second lever arm to the cable of the bow.

5. The apparatus of claim 4 wherein the length of the tether is adjustable, thereby enabling adjustment of the magnitude or timing of the force exerted by the cable on the second lever arm during the latter portion of shooting the arrow by the bow.

6. The apparatus of claim 2 wherein the support member, the rotating member, the lever, the linkage, and the arrow rest are arranged to enable adjustment of the duration of the latter portion of the time interval during shooting of the bow.

7. The apparatus of claim 2 wherein the support member, the rotating member, the lever, the linkage, and the arrow rest are arranged so that the latter portion is less than about 40% of the time interval.

8. The apparatus of claim 2 wherein the support member, the rotating member, the lever, the linkage, and the arrow rest are arranged so that the latter portion is less than about 20% of the time interval.

9. The apparatus of claim 1 wherein the linkage comprises an over-center linkage having a first linking member connected to the first lever arm and a second linking member connected to the rotating member, the first and second linking members being connected together at a linkage pivot point, the first and second linking members being arranged to (i) assume an over-center arrangement with the lever in its cocked position, (ii) remain in the over-center arrangement as the linkage is urged against the rotating member, and (iii) pivot about the linkage pivot point out of the over-center arrangement as a result of rotation of the rotating member past its release position against its bias, thereby enabling the rotating member to rotate to its resting position in response to its bias.

10. The apparatus of claim 9 wherein the rotating member is arranged to urge the linkage pivot point out of the over-center arrangement as the rotating member rotates past its release position against its bias.

11. The apparatus of claim 1 wherein the linkage comprises a linking member connected to the first lever arm, the rotating member has a notch for receiving the linking member, and the linking member and the rotating member are arranged so that (i) the linking member engages the notch with the lever in its cocked position and the rotating member in its resting position, (ii) the linking member remains engaged with the notch as the linkage is urged against the rotating member, and (iii) the linking member disengages from the notch as a result of rotation of the rotating member past its release position against its bias, thereby enabling the rotating member to rotate to its resting position in response to its bias.

12. An archery bow comprising:

oppositely projecting first and second bow limbs;

a first pulley member pivotably connected to the first bow limb;

a second pulley member pivotably connected to the second bow limb;

a draw cable engaged with the first and second pulley members;

at least one additional cable engaged with the first or second pulley member; and an arrow rest assembly comprising (i) a support member, (ii) a rotating member, (iii) an arrow rest connected to the rotating member, (iv) a lever comprising first and second lever arms, and (v) a linkage coupling the first lever arm and the rotating member, wherein:

the rotating member is rotatably mounted on the support member at a first pivot point of the support member, the rotating member being biased toward a rest position against a rotation stop;

the lever is rotatably mounted on the support member at a second pivot point of the support member, the lever being biased toward a cocked position;

the support member, the rotating member, the lever, and the linkage are arranged so that (i) with only substantially negligible force exerted on the second lever arm, the lever assumes its cocked position in response to its bias, (ii) in response to an external force exerted on the second lever arm to rotate the lever away from its cocked position against its bias, the first lever arm urges the linkage against the rotating member so as to rotate the rotating member away from its resting position against its bias, and (iii) in response to the rotating member being rotated against its bias by the linkage past a release position, the linkage allows the rotating member to rotate to its resting position in response to its bias;

the support member is connected to the bow so that the arrow rest is positioned (i) to support, with the rotating member in its rest position, the shaft of an arrow nocked and ready for drawing or drawn and ready for shooting, and (ii) to allow, with the rotating member at or past its release position, substantially unimpeded passage of the fletching of the arrow during shooting of the arrow by the bow; and the second lever arm is arranged to be connected to the additional cable of the bow so that (i) the additional cable exerts only substantially negligible force on the second lever arm with the bow drawn, and (ii) the cable exerts a force on the second lever arm, during only the latter portion of a time interval corresponding to shooting of the arrow by the bow, that urges the linkage against the rotating member so as to rotate the rotating member away from its resting position and past its release position against its bias.

13. The bow of claim 12 wherein the support member includes adjustment screws arranged to enable adjustable positioning of the support member on the archery bow.

14. The bow of claim 12 further comprising a flexible tether connected to the second lever arm and arranged to connect the second lever arm to the additional cable of the bow.

15. The bow of claim 14 wherein the length of the tether is adjustable, thereby enabling adjustment of the magnitude or timing of the force exerted by the cable on the second lever arm during the latter portion of shooting the arrow by the bow.

16. The bow of claim 12 wherein the support member, the rotating member, the lever, the linkage, and the arrow rest are arranged to enable adjustment of the duration of the latter portion of the time interval during shooting of the bow.

17. The bow of claim 12 wherein the support member, the rotating member, the lever, the linkage, and the arrow rest are arranged so that the latter portion is less than about 40% of the time interval.

18. The bow of claim 12 wherein the support member, the rotating member, the lever, the linkage, and the arrow rest are arranged so that the latter portion is less than about 20% of the time interval.

19. The bow of claim 12 wherein the linkage comprises an over-center linkage having a first linking member connected to the first lever arm and a second linking member connected to the rotating member, the first and second linking members being connected together at a linkage pivot point, the first and second linking members being arranged to (i) assume an over-center arrangement with the lever in its cocked position, (ii) remain in the over-center arrangement as the linkage is urged against the rotating member, and (iii) pivot about the linkage pivot point out of the over-center arrangement as a result of rotation of the rotating member past its release position against its bias, thereby enabling the rotating member to rotate to its resting position in response to its bias.

20. The bow of claim 19 wherein the rotating member is arranged to urge the linkage pivot point out of the over-center arrangement as the rotating member rotates past its release position against its bias.

21. The bow of claim 12 wherein the linkage comprises a linking member connected to the first lever arm, the rotating member has a notch for receiving the linking member, and the linking member and the rotating member are arranged so that (i) the linking member engages the notch with the lever in its cocked position and the rotating member in its resting position, (ii) the linking member remains engaged with the notch as the linkage is urged against the rotating member, and (iii) the linking member disengages from the notch as a result of rotation of the rotating member past its release position against its bias, thereby enabling the rotating member to rotate to its resting position in response to its bias.

22. A method comprising:

(a) rotatably mounting a rotating member on a support member at a first pivot point of the support member, and biasing the rotating member toward a rest position against a rotation stop;

(b) rotatably mounting a lever on the support member at a second pivot point of the support member, and biasing the lever toward a cocked position, the lever comprising first and second lever arms;

(c) coupling the first lever arm and the rotating member with a linkage; and (d) arranging the support member, the rotating member, the lever, and the linkage so that (i) with only substantially negligible force exerted on the second lever arm, the lever assumes its cocked position in response to its bias, (ii) in response to an external force exerted on the second lever arm to rotate the lever away from its cocked position against its bias, the first lever arm urges the linkage against the rotating member so as to rotate the rotating member away from its resting position against its bias, and (iii) in response to the rotating member being rotated against its bias by the linkage past a release position, the linkage allows the rotating member to rotate to its resting position in response to its bias.

23. The method of claim 22 further comprising:

(e) connecting an arrow rest to the rotating member;

(f) arranging the support member to be connected to an archery bow so that the arrow rest is positioned (i) to support, with the rotating member in its rest position, the shaft of an arrow nocked and ready for drawing or drawn and ready for shooting, and (ii) to allow, with the rotating member at or past its release position, substantially unimpeded passage of the fletching of the arrow during shooting of the arrow by the bow; and (g) arranging the second lever arm to be connected to a cable of the bow so that (i) the cable exerts only substantially negligible force on the second lever arm with the bow drawn, and (ii) the cable exerts a force on the second lever arm, during only the latter portion of a time interval corresponding to shooting of the arrow by the bow, that urges the linkage against the rotating member so as to rotate the rotating member away from its resting position and past its release position against its bias.

24. A method comprising:

(a) pivotably connecting a first pulley member to a first bow limb of an archery bow;

(b) pivotably connecting a second pulley member to a second bow limb of the archery bow;

(c) engaging a draw cable with the first and second pulley members;

(d) engaging at least one additional cable with the first or second pulley member; and (e) connecting an arrow rest assembly to the bow, the arrow rest assembly comprising (i) a support member, (ii) a rotating member, (iii) an arrow rest connected to the rotating member, (iv) a lever comprising first and second lever arms, and (v) a linkage coupling the first lever arm and the rotating member, wherein:

the rotating member is rotatably mounted on the support member at a first pivot point of the support member, the rotating member being biased toward a rest position against a rotation stop;

the lever is rotatably mounted on the support member at a second pivot point of the support member, the lever being biased toward a cocked position;

the support member, the rotating member, the lever, and the linkage are arranged so that (i) with only substantially negligible force exerted on the second lever arm, the lever assumes its cocked position in response to its bias, (ii) in response to an external force exerted on the second lever arm to rotate the lever away from its cocked position against its bias, the first lever arm urges the linkage against the rotating member so as to rotate the rotating member away from its resting position against its bias, and (iii) in response to the rotating member being rotated against its bias by the linkage past a release position, the linkage allows the rotating member to rotate to its resting position in response to its bias;

the support member is connected to the bow so that the arrow rest is positioned (i) to support, with the rotating member in its rest position, the shaft of an arrow nocked and ready for drawing or drawn and ready for shooting, and (ii) to allow, with the rotating member at or past its release position, substantially unimpeded passage of the fletching of the arrow during shooting of the arrow by the bow; and the second lever arm is arranged to be connected to the additional cable of the bow so that (i) the additional cable exerts only substantially negligible force on the second lever arm with the bow drawn, and (ii) the cable exerts a force on the second lever arm, during only the latter portion of a time interval corresponding to shooting of the arrow by the bow, that urges the linkage against the rotating member so as to rotate the rotating member away from its resting position and past its release position against its bias.

* * * * *

UNITED STATES PATENT AND TRADEMARK OFFICE

CERTIFICATE OF CORRECTION

PATENT NO. : 7,717,103 B2
APPLICATION NO. : 11/877629
DATED : May 18, 2010
INVENTOR(S) : Johnson It is certified that error appears in the above-identified patent and that said Letters Patent is hereby corrected as shown below:

Column 5, line 40: insert --by the bow-- after "arrow".

Column 6, line 2: insert --arrow by the-- between "the" and "bow".

Column 8, line 48 (Claim 6, last line): insert --arrow by the-- between "the" and "bow".

Column 10, line 20 (Claim 16, last line): insert --arrow by the-- between "the" and "bow".

Signed and Sealed this

Tenth Day of August, 2010

David J. Kappos

David J. Kappos
*Director of the United States Patent and Trademark Office*